United States Patent [19]

Turner

[11] Patent Number: 4,810,225

[45] Date of Patent: Mar. 7, 1989

[54] SOUND PRODUCING TOY

[76] Inventor: James A. Turner, 811 Surghnor Ave., Belton, Tex. 76513

[21] Appl. No.: 80,656

[22] Filed: Aug. 3, 1987

[51] Int. Cl.[4] ..... A63H 5/00

[52] U.S. Cl. ..... 446/271; 446/418

[58] Field of Search ..... 446/270–272, 446/297, 397, 409–414, 418, 265, 420–422, 404, 405, 406, 408, 415; D21/64, 160

[56] References Cited

U.S. PATENT DOCUMENTS 2,410,646 11/1946 Finn et al. ..... 446/272

3,621,606 11/1971 Potrzuski ..... 446/297

FOREIGN PATENT DOCUMENTS 2103948 3/1983 United Kingdom ..... 446/270

*Primary Examiner*—Mickey Yu

*Attorney, Agent, or Firm*—Leon Gilden

[57] ABSTRACT

A wheeled toy duck is attached to a stick which allows it to be pushed along a ground surface. Flexible flap members are attached to the wheels and alternately "slap" the floor to produce sound while the toy is being pushed by a child.

3 Claims, 2 Drawing Sheets

SOUND PRODUCING TOY

BACKGROUND OF THE INVENTION

1. Field of the Invention

The present invention relates to toys, and more particularly pertains to a wheeled sound producing toy.

2. Description of the Prior Art

Wheeled animal-like toys are well known in the prior art. A typical wheeled toy is to be found in U.S. Pat. No. Des. 206,601 which issued to W. Elzaurdia, et al on Jan. 3, 1967. The toy illustrated in this patent is designed to be pulled by a tether. A similar toy is to be found in U.S. Pat. No. Des. 141,000 which issued to L. Laskey on Apr. 24, 1945. The toy animal figure illustrated in this latter patent depicts a wheeled pelican and has a push rod designed to be held by a child to facilitate a wheeled movement thereof over a floor surface.

While both of these above-described toys are certainly entertaining to a child, it can be appreciated that there is a continuing interest in providing additional features to such toys which would increase a child's interest therein. For example, numerous toys incorporate the use of sound producing mechanisms or devices, and it is quite conceivable that such sound producing mechanisms are presently being utilized on wheeled animal toys. However, most of these prior art sound producing mechanisms or devices are complex in design or expensive to manufacture, and in this respect, there is a continuing need for simplistic sound producing means which could be incorporated into various wheeled toys. The present invention addresses this continuing need.

SUMMARY OF THE INVENTION

In view of the foregoing disadvantages inherent in the known types of wheeled animal toys now present in the prior art, the present invention provides an improved wheeled animal toy wherein the same includes means for producing sound during a use of the toy. As such, the general purpose of the present invention, which will be described subsequently in greater detail, is to provide a new and improved wheeled animal toy which has all the advantages of the prior art wheeled animal toys and none of the disadvantages.

To attain this, the present invention comprises a toy duck having a pair of wheels and a rigid push rod which facilitates a wheeled movement of the duck by a child holding the rod. Each of the wheels is provided with an attached flexible flap extending outwardly from a peripheral portion thereof, and these flaps alternately slap the floor as the wheels turn. As such, the flaps provide for a "slapping sound" as the toy duck is moved.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways.

Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sound producing wheeled animal toy which has all the advantages of the prior art sound producing wheeled animal toys and none of the disadvantages.

It is another object of the present invention to provide a new and improved sound producing wheeled animal toy which may be easily and efficiently manufactured and marketed.

It is a further object of the present invention to provide a new and improved sound producing wheeled animal toy which is of a durable and reliable construction.

An even further object of the present invention is to provide a new and improved sound producing wheeled animal toy which is susceptible of a low cost of manufacture with regard to both materials and labor, and which accordingly is then susceptible of low prices of sale to the consuming public, thereby making such sound producing wheeled animal toys economically available to the buying public.

Still yet another object of the present invention is to provide a new and improved sound producing wheeled animal toy which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
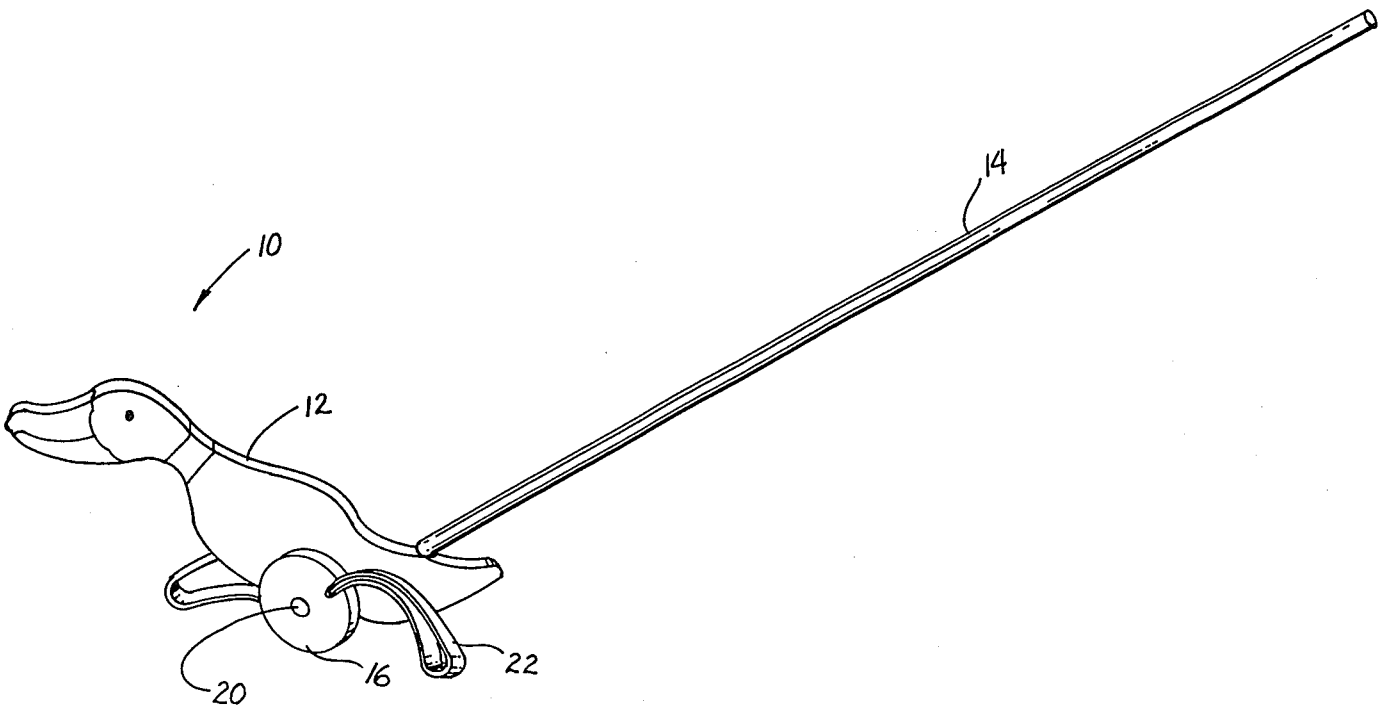
FIG. 1 is a side elevation view of the wheeled toy animal comprising the present invention.
Figure 2:
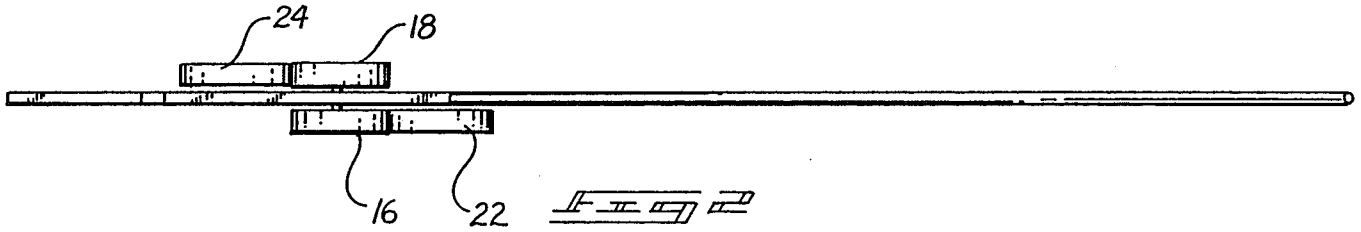
FIG. 2 is a top plan view of the toy.

With reference now to the drawings, and in particular to FIGS. 1 and 2 thereof, a new and improved sound producing wheeled animal toy embodying the principles and concepts of the present invention and generally designated by the reference numeral 10 will be described.

More specifically, it will be noted that toy 10 essentially comprises a rigid representation 12 of a duck to which an extended push rod 14 is fixedly secured. A pair of wheels 16, 18 are rotatably attached to a axle 20 which is secured to the duck 12 in a conventional manner. As such, an individual may grasp the rod 14 and accomplish a wheeled movement of the duck 12 over a floor surface.

To achieve the desired sound producing effect from the toy duck 12, a pair of flexible flaps 22, 24 are respectively attached to peripheral edges of the wheels 16, 18. The flaps 22, 24 may be attached to the respective wheels 16, 18 by any conventional means and, as clearly illustrated in FIG. 1, the flaps are of a looped design to increase their noise producing capability. More particularly, it can be appreciated that the flaps 22, 24 will alternately slap the floor surface as the wheels 16, 18 rotate inasmuch as the flaps extend outwardly from the peripheral edge portions of the wheels. The loops comprising the flaps 22, 24 will collapse when they slap against the ground surface, thereby to increase air movement around the flaps and the attendant noise level. Additionally, the flaps 22, 24 will cause the wheels 16, 18 to move slightly off of the ground surface during their engagement therewith, which in turn permits the wheels to add to the noise producing effect inasmuch as they will effectively "bounce" along the floor. The level of sound produced can be adjusted by increasing or decreasing the length of the flaps 22, 24 as well as their widths and weight. Further, various materials such as rubber, plastic, and the like, can be utilized to accomplish different noise producing effects.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation *shown and described, and accordingly, all suitable modifications* and equivalents may be resorted to, falling within the scope of the invention.

What is claimed as being new and desired to be protected by Letters Patent of the United States is as follows:

1. A new and improved sound producing wheeled toy comprising:

toy animal means;

wheel means rotatably mounted to said toy animal means, said wheel means facilitating a wheeled movement of said toy means over a ground surface;

push rod means fixedly attached to said toy animal means, said push rod means being designed to be grasped by an individual to thereby facilitate a pushing and pulling movement of said toy animal means over said ground surface;

first sound producing means forming a part of said wheel means; and second sound producing means forming a part of said wheel means, and wherein said first sound producing means comprises at least one flexible flap attached to said wheel means, said flexible flap extending outwardly from and fixedly secured to a peripheral portion of said wheel means whereby said flexible flap continually slaps against said ground surface during a rotation of said wheel means, thereby to produce a first sound effect; and wherein said second sound producing means comprises a bouncing movement of said wheel means along said ground surface, said wheel means continually slapping against said ground surface to produce a second sound effect, and wherein said flexible flap effects a bounding movement of said wheel means to create said second sound effect, and wherein said flexible flap is formed in a free unrestrained loop, said loop collapsing to produce a third sound producing effect during a wheeled movement of said toy animal means; and wherein said collapsing of said loop is accomplished by said flexible flap slapping against said ground surface during a rotatable movement of said wheel means.

2. The new and improved sound producing toy as described in claim 1, wherein said flexible flap is formed from rubber.

3. The new and improved sound producing toy as described in claim 1, wherein said flexible flap is formed from plastic.

* * * * *